US011112161B1

(12) United States Patent
Hoffman et al.

(10) Patent No.: US 11,112,161 B1
(45) Date of Patent: Sep. 7, 2021

(54) ICE MACHINE

(71) Applicant: Aqua Star International, LLC, Tucson, AZ (US)

(72) Inventors: Glenn Hoffman, Tucson, AZ (US); Robert Joseph Hoffman, Tucson, AZ (US)

( * ) Notice: Subject to any disclaimer, the term of this patent is extended or adjusted under 35 U.S.C. 154(b) by 0 days.

(21) Appl. No.: 17/314,703

(22) Filed: May 7, 2021

Related U.S. Application Data

(63) Continuation-in-part of application No. 16/600,104, filed on Oct. 11, 2019, now Pat. No. 11,041,668.

(51) Int. Cl.
*F25C 5/20* (2018.01)

(52) U.S. Cl.
CPC ..... *F25C 5/24* (2018.01); *F25C 2400/04* (2013.01); *F25C 2400/10* (2013.01)

(58) Field of Classification Search
CPC .. F25C 5/24; F25C 5/182; F25C 1/147; F25C 2400/10; F25C 2400/04; F25C 5/20
See application file for complete search history.

(56) References Cited

U.S. PATENT DOCUMENTS

| | | | |
|---|---|---|---|
| 3,151,668 | A | 10/1964 | Zimmermann |
| 3,717,286 | A | 2/1973 | Crider |
| 5,112,477 | A | 5/1992 | Hamlin |
| 2010/0313524 | A1 | 12/2010 | Pape |
| 2016/0292953 | A1 | 10/2016 | Brown |
| 2018/0187939 | A1 | 7/2018 | Blosser |

*Primary Examiner* — Elizabeth J Martin
(74) *Attorney, Agent, or Firm* — Yakov Sidorin; Quarles & Brady LLP

(57) ABSTRACT

An ice machine including a cabinet with a cabinet door coupled thereto through a hinge assembly. A frame within the cabinet includes a base portion and a support portion supporting a hopper that contains an ice dispensing interface. A housing is operably coupled with the cabinet door and defines an ice harvesting chamber having a bottom (floor) portion containing multiple levels as defined by separation of the bottom portion from the top of the housing and a drain. A chute is coupled with the housing and is in communication with the ice dispensing interface. A container hanging assembly is coupled with the chute. An attachment rod, coupled to the housing, is positioned on a side of the chute opposite to the container hanging assembly.

20 Claims, 14 Drawing Sheets

ICE MACHINE

CROSS-REFERENCE TO RELATED APPLICATIONS

This US Patent application is a continuation-in-part from the U.S. patent application Ser. No. 16/600,104 filed on Oct. 11, 2019 and now published as US 2021/0108846, the entire disclosure of which is incorporated herein by reference.

TECHNICAL FIELD

The present disclosure generally relates to ice making and dispensing devices.

RELATED ART

Ice vending machines can output prepackaged containers of ice and/or produce ice that is packaged at the vending machine. When packaged at the ice machine, the ice machine includes an ice maker and a hopper. Ice exits the hopper and is dispensed through a chute. A container is positioned at a lower end of the chute in the so-called vending compartment that is dimensioned to prevent the container from coming in contact with fluid present in the vending compartment. The container is judiciously disposed to catch and accommodate the dispensed ice.

SUMMARY OF THE INVENTION

Embodiments of the invention provide an ice machine that includes a cabinet (defining a compartment and having a cabinet door coupled thereto through a hinge assembly) and a frame removably positioned within the cabinet and laterally offset relative to a lateral centerline of the compartment. The ice machine also contains a hopper that is supported by the frame (such hopper includes an ice dispensing interface) and a housing having a top and a bottom and affixed to the cabinet door to be moved from inside the compartment when the cabinet door is opened. This housing defines an ice harvesting chamber. The bottom of the housing includes a surface separated from the top by a first distance at a first location at such surface and by a second distance at a second location at such surface, the first distance and the second distance are not equal to one another. The ice machine additionally includes at least a chute coupled with the housing and in communication with the ice dispensing interface; and a container hanging assembly operably coupled with the chute.

Embodiments further provide an ice machine that includes a cabinet (defining a compartment with a compartment volume and having a cabinet door coupled thereto through a hinge assembly) with a frame surrounding a frame volume and removably positioned within the cabinet. The frame includes a base portion of the frame and a support portion of the frame, and is laterally offset relative to a lateral centerline of the compartment. The frame volume is smaller than the compartment volume. A hopper is disposed on top of the support portion of the frame and has an ice dispensing interface. A chute is coupled with a housing that hangs on the cabinet door and is in communication with the ice dispensing interface. The housing has a bottom that is unequally distanced from the hopper at first and second locations along the bottom.

Embodiments additionally provide an ice machine that, in addition to a cabinet enclosing a compartment with a compartment volume and having a cabinet door hingedly coupled thereto, includes a frame surrounding a frame volume that is smaller than the compartment volume (such frame is being repositionably located within the cabinet and supports a hopper with the support portion of the frame). The frame is offset from a lateral centerline of the compartment. The ice machine further contains a housing defining an ice harvesting (or, interchangeably, vending) chamber with a bottom configured to define at least first and second levels of the bottom along a vertical direction. The housing is attached to the cabinet door whereby the ice harvesting chamber is hinged away from the compartment volume when the cabinet door is opened. The ice machine includes a chute coupled with the housing and in communication with the ice dispensing interface; and an attachment rod attached to and extending through a rear wall of the housing and including a retainer on an end portion thereof (the retainer disposed vertically above a lower portion of the chute).

BRIEF DESCRIPTION OF THE DRAWINGS

The invention will be more fully understood by referring to the following Detailed Description of Specific Embodiments in conjunction with the not-to scale Drawings, of which.

Figure 1A:
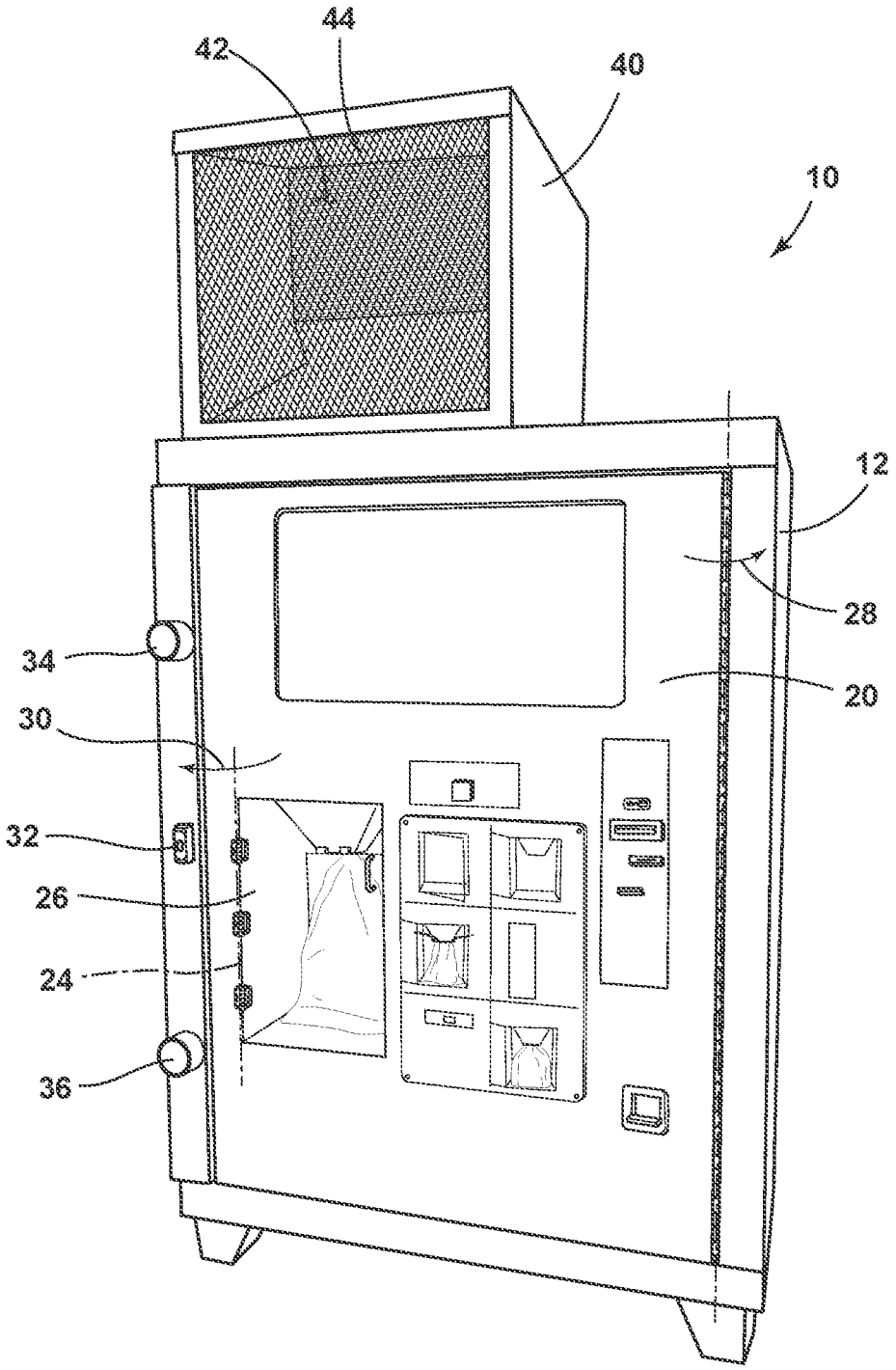
FIG. 1A is a front perspective view of an ice machine having a cabinet and a door, according to some examples.

Generally, the sizes and relative scales of elements in Drawings may be set to be different from actual ones to appropriately facilitate simplicity, clarity, and understanding of the Drawings. For the same reason, not all elements present in one Drawing may necessarily be shown in another.

DETAILED DESCRIPTION

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply non-limiting examples of the inventive concepts defined in the appended claims. Hence, specific dimensions and other physical characteristics relating to the examples disclosed herein are not to be considered as limiting, unless the claims expressly state otherwise.

As required, detailed examples of the present invention are disclosed herein. However, it is to be understood that the disclosed examples of the invention may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition or assembly is described as containing components A, B, and/or C, the composition or assembly can contain A alone; B alone; C alone; A and B in combination; A and C in combination; B and C in combination; or A, B, and C in combination.

The following disclosure describes a free-standing ice machine that may be placed virtually anywhere. The ice machine can be used by a consumer to purchase freshly bagged ice and, in some cases, chilled water that is ready for consumption. In some examples, the ice machine includes a cabinet and supports a cabinet door hingedly coupled thereto. A frame is positioned within the cabinet and includes a base portion and a support portion. A cooling module is supported by the support portion of the frame and includes an ice maker and a hopper. The hopper is operably coupled with an ice dispensing interface. A trough is coupled with the base portion of the frame and is fluidly coupled with a fluid outlet. A housing is operably coupled with the door and defines an ice harvesting chamber. A chute is coupled with the housing and is in communication with the ice dispensing interface of the cooling module. A container hanging assembly is coupled with the chute. A chamber door is hingedly coupled to the cabinet door and is configured to provide access to an ice harvesting chamber in an open position.

In the example illustrated in FIG. 1A, an ice machine 10 includes a cabinet 12 that defines a compartment 14. The compartment 14 may be accessed through a front access opening 16 and/or a top access opening 18. A cabinet door 20 is coupled to the cabinet 12 through a hinge assembly 22 having one or more hinges and provides selective access to the compartment 14 of the cabinet 12 through the front access opening 16.

The cabinet door 20 may further define a void that allows access to an ice harvesting chamber 24. A chamber door 26 is hingedly coupled to the cabinet door 20 and can provide access to an ice harvesting chamber 24 in an open position. When not in use, the chamber door 26 may be placed in a closed position to assist in retaining chilled air within the cabinet 12. In some instances, the cabinet door 20 may rotate in a first direction (e.g., 28) about a vertical axis and the chamber door 26 may rotate in a second, opposing direction (e.g., 30) about a vertical axis.

In some instances, when the cabinet door 20 is placed in the closed position, one or more locks 32, 34, 36 may be used to prevent unwanted opening of the cabinet door 20. For example, as illustrated in FIG. 1A, a first lock 32 may be positioned on an opposite side of the cabinet door 20 from the hinge assembly 22. The first lock 32 may be configured as a plug lock or a handle lock that includes a lock body that is fixed to the door 20 and retains the cabinet door 20 in the closed position through retainment within a void 38 defined by the cabinet 12.

Second and third locks 34, 36 may be disposed vertically above and/or below the first lock 32. In some instances, the second and third locks 34, 36 are of a varying type from the first lock 32. For example, the second and third locks 34, 36 may be configured at padlocks having locking bodies coupled to the cabinet door 20 that interact with anchor assemblies that are fixed to the cabinet 12.

Figure 1B:
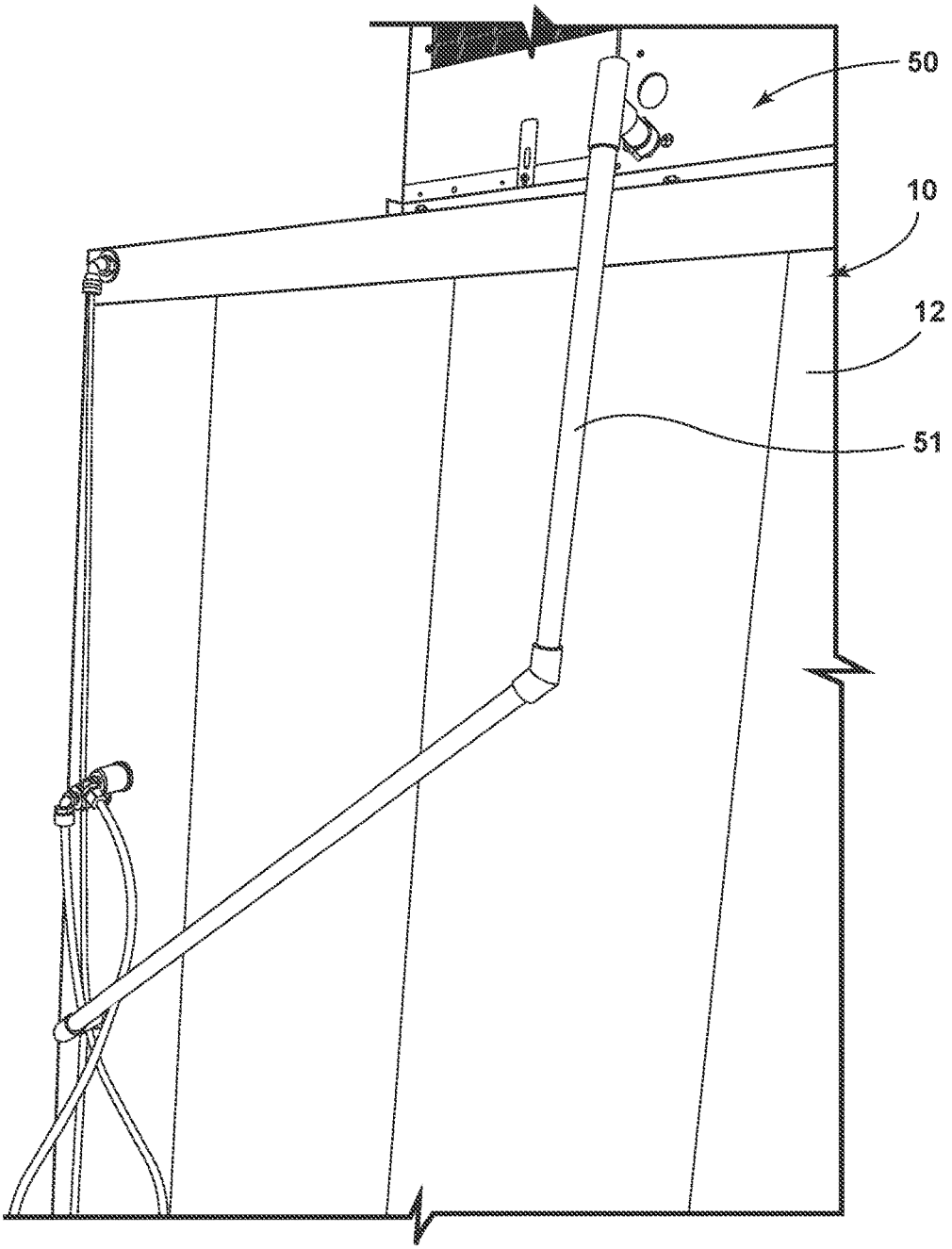
FIG. 1B is a rear perspective view of the ice machine, according to some examples.

With reference to FIG. 1B, a cooling module drain pipe 51 may be coupled with the cooling module 50 that is disposed at least partially above the cabinet 12. In some instances, the cooling module drain pipe 51 extends along an exterior portion of the cabinet and through an opening in the cabinet 12 such that a first portion of the drain pipe 51 is fluidly coupled to the cooling module externally from the cabinet and a second opposing portion of the drain pipe 51 is positioned within the compartment 14. It will be appreciated that in some examples, the drain pipe 51 may be concealed within the compartment or maintain a position external from the compartment 14 without departing from the teachings provided herein.

Figure 2A:
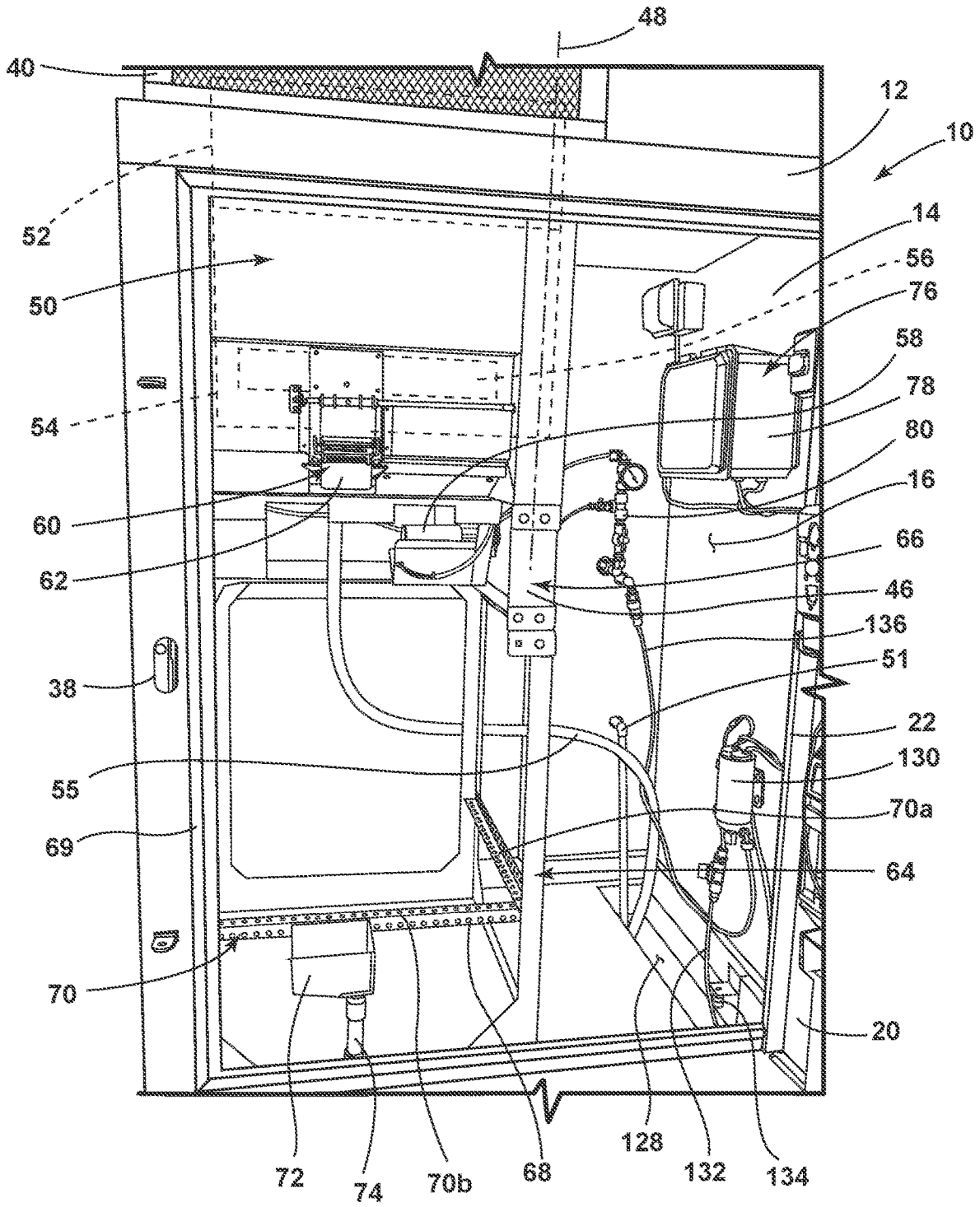
FIG. 2A is a front perspective view of the ice machine with the door in an open position, according to some examples.
Figure 2B:
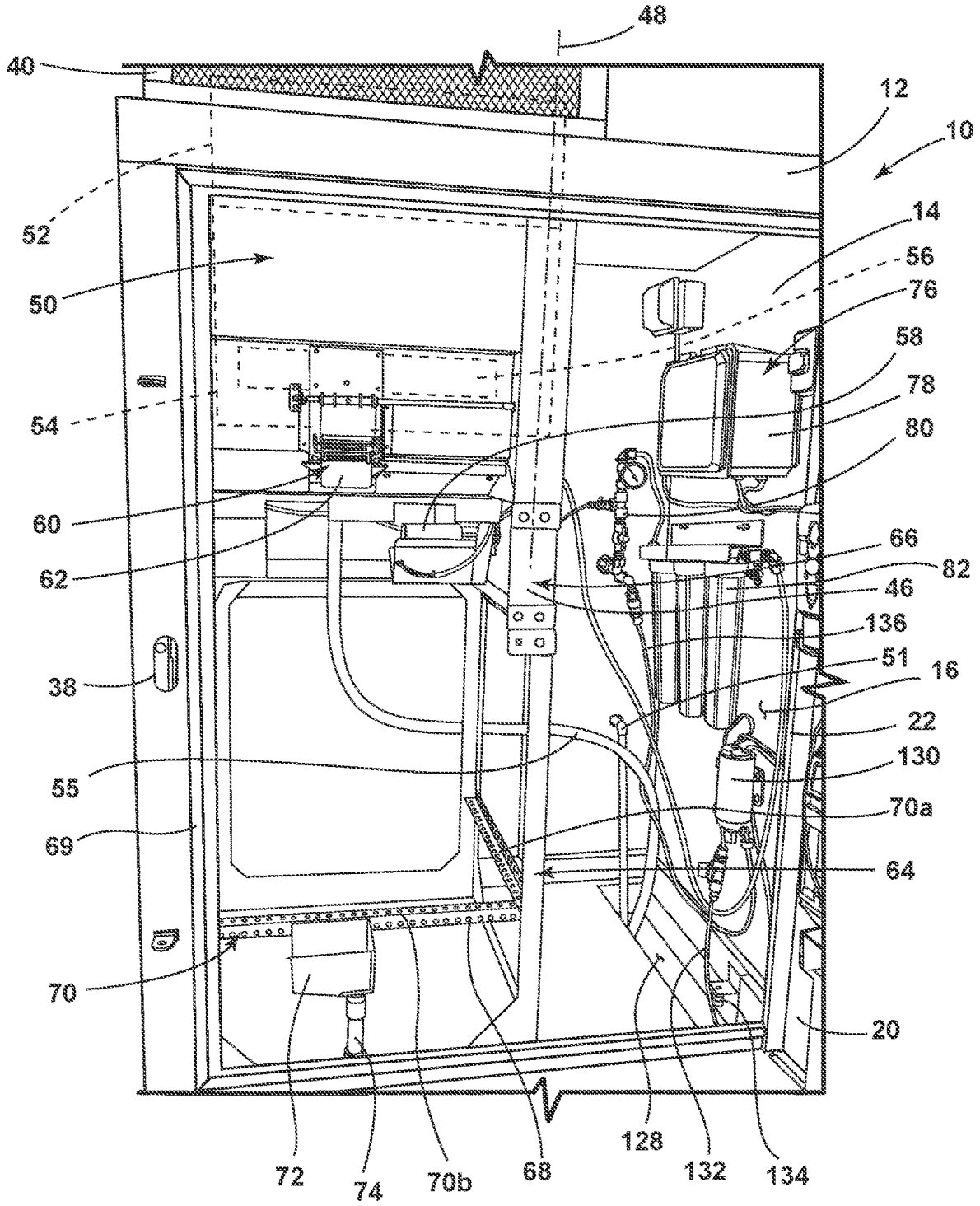
FIG. 2B is a front perspective view of the ice machine with the door in the open position and having a filter assembly, according to some examples.
Figure 3:
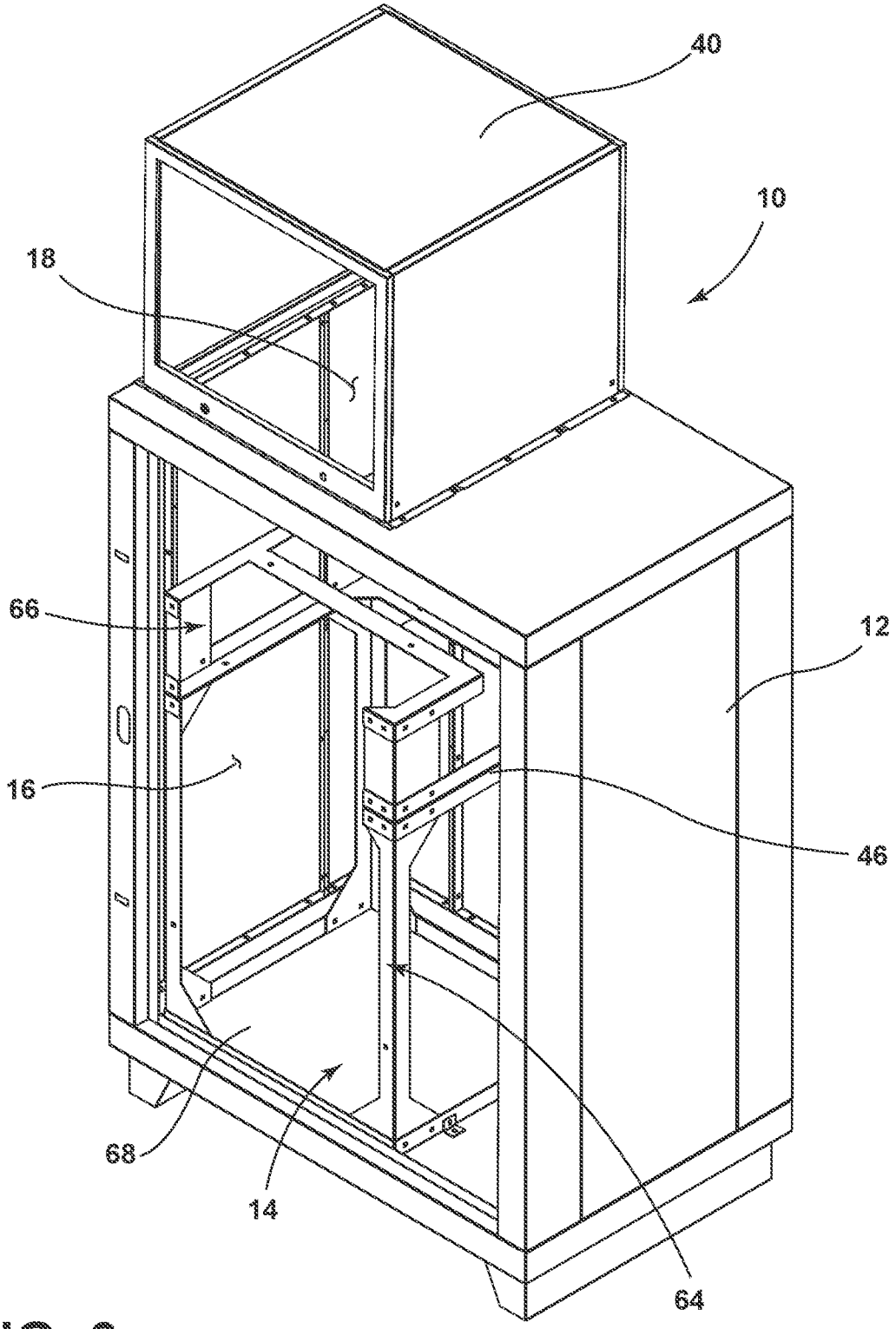
FIG. 3 is a front side perspective view of the ice machine with a frame positioned within the cabinet, according to some examples.
Figure 4:
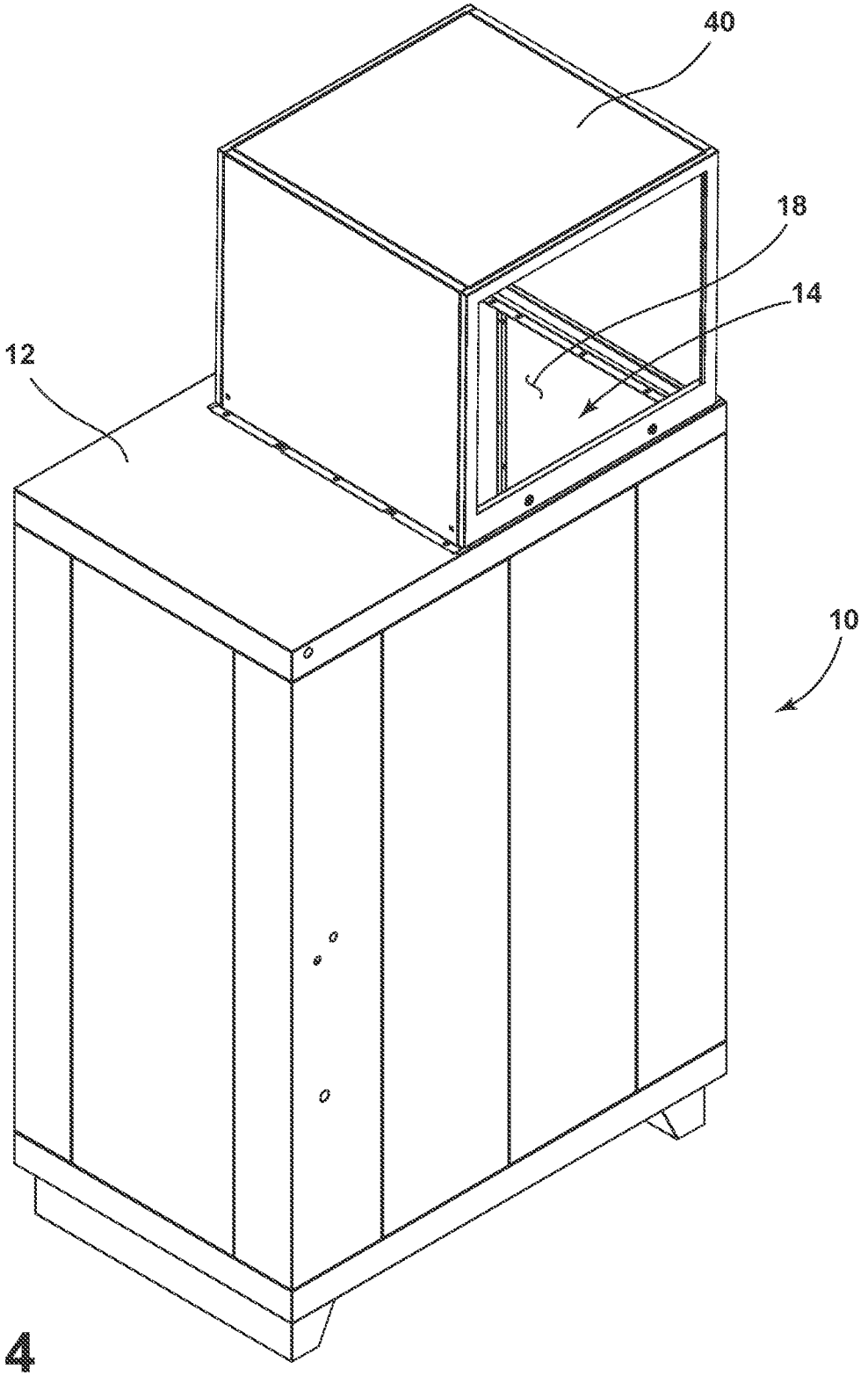
FIG. 4 is rear side perspective view of the cabinet of the ice machine, according to some examples.
Figure 5:
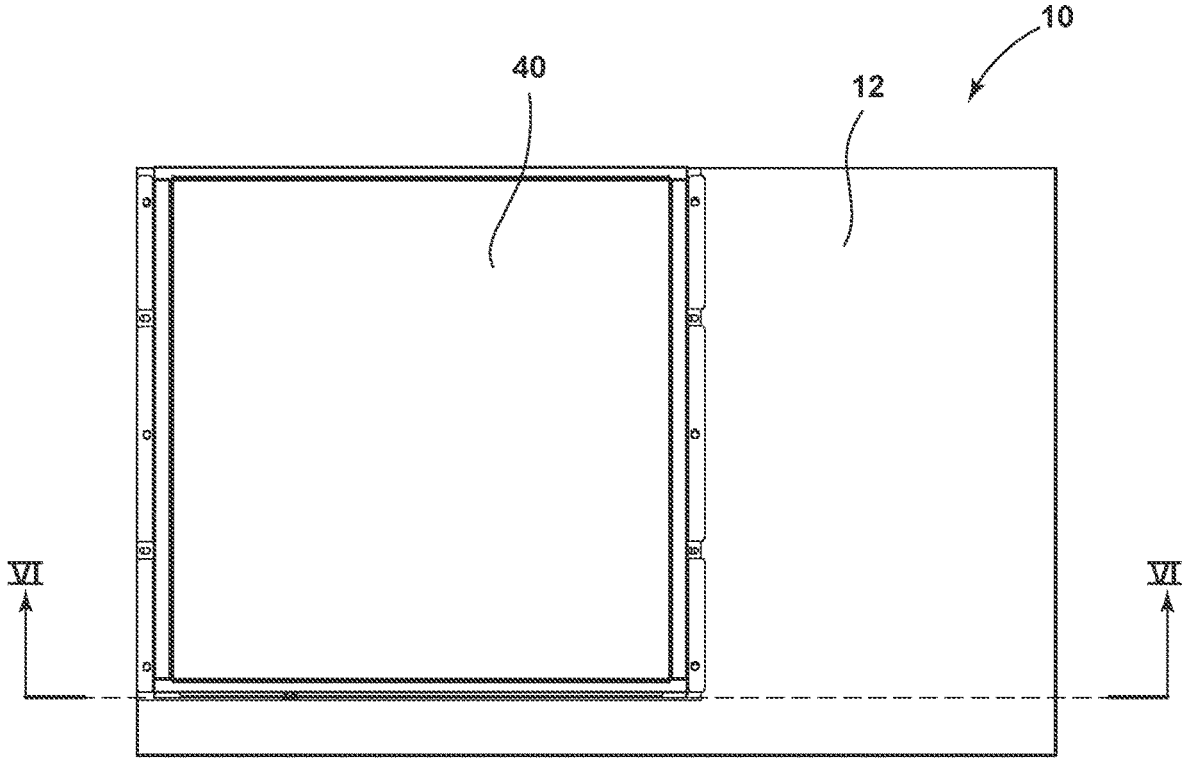
FIG. 5 is a top plan view of the cabinet, according to some examples.
Figure 6:
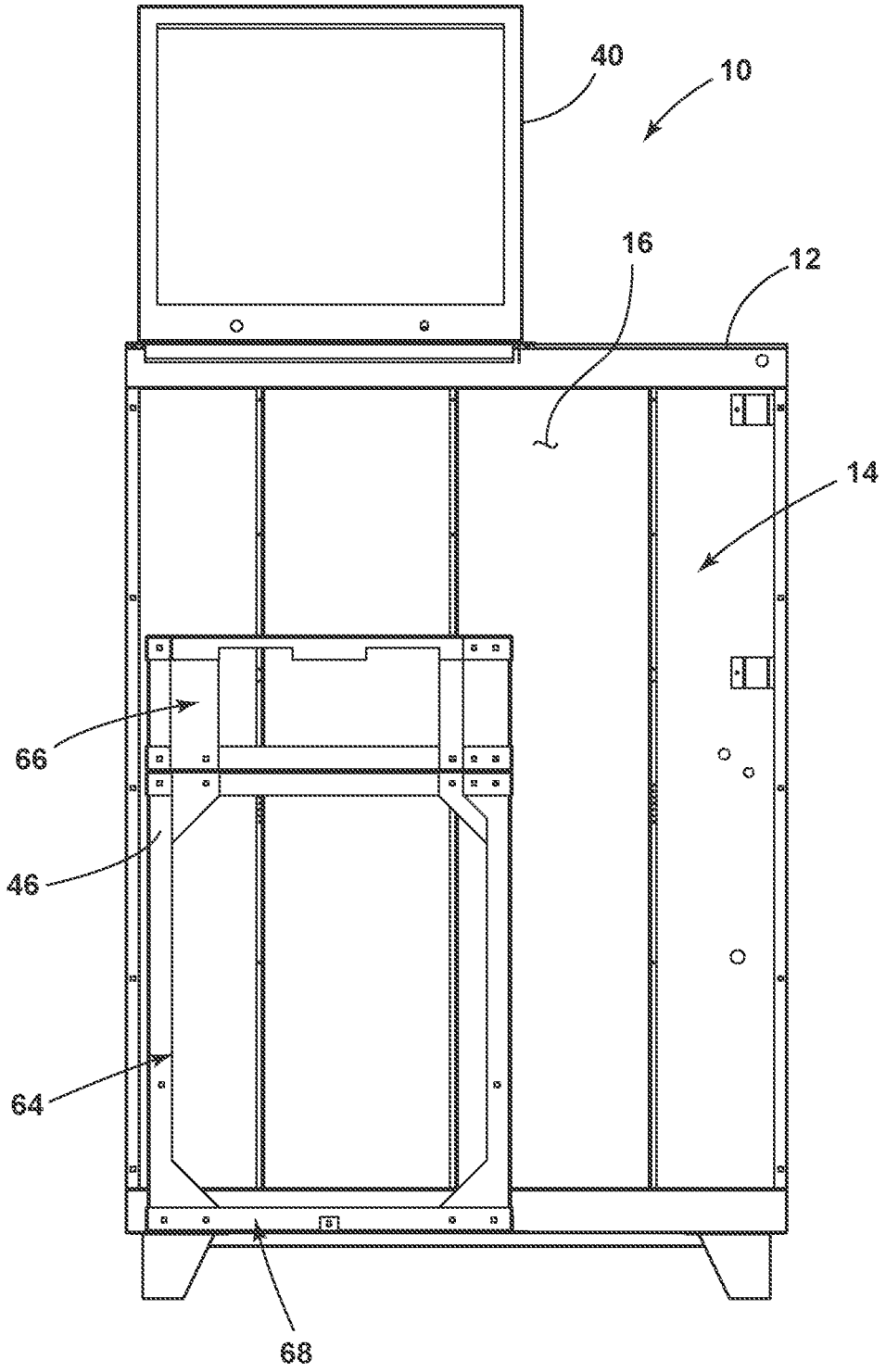
FIG. 6 is a cross-sectional view of the cabinet and the frame taken along the line VI-VI of FIG. 5.
Figure 7:
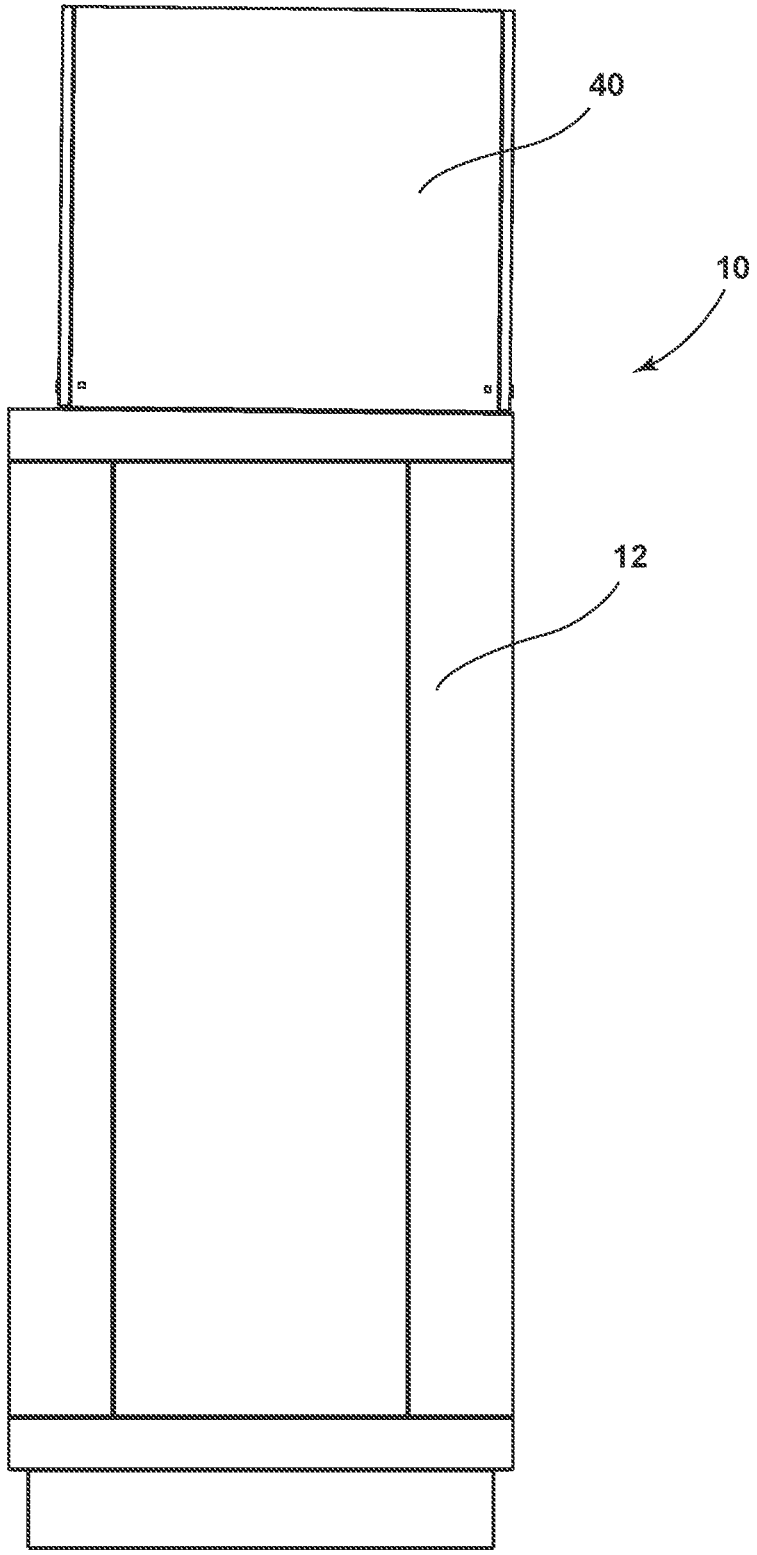
FIG. 7 is a side plan view of the cabinet, according to some examples.

A frame 46 can be positioned within the compartment 14 and includes any number of portions for supporting various components of the ice machine 10. In some examples, the frame 46 may be formed of any material and can be fixed to the cabinet 12 or free-standing. As illustrated in FIGS. 2A and 2B, a frame 46 may be fixed in an offset position relative to a lateral compartment centerline 48. In some instances, the frame 46 may be positioned on an opposing side of the cabinet 12 from the hinge assembly 22 supporting the cabinet door 20 thereby allowing access to various components that are supported by the frame 46. For example, in the embodiments illustrated in FIGS. 2A and 2B, the frame 46 can support a cooling module 50 that includes an ice maker 52 and/or a hopper 54. The ice maker 52 may include any device capable of freezing water to form ice. The amount of ice produced is controlled by limit switches that sense the amount of ice that is stored in the hopper 54 ready for delivery, the limit switches being operable to either activate or deactivate the ice maker 52, as production warrants. Ice produced in the ice maker 52 is deposited into the hopper 54, which may be insulated.

An agitator 56 may be positioned in the hopper 54 and is rotated using a motor 58. In some examples, the agitator 56 may periodically agitate the ice contained in the storage bin is to keep the ice in a fluid state and to maintain the ice in a level orientation with respect to the storage bin. Maintaining the ice at a level orientation generally ensures that the hopper 54 is maintained in a substantially predefined capacity.

In some examples, the hopper 54 includes an ice dispensing interface 60 having a flap 62 thereon that is positioned over an exit aperture of the hopper 54. The flap 62 may be moved between a closed position in which the flap 62 prevents ice from exiting the hopper 54 through the exit aperture and an open position in which ice may exit the hopper 54 through the aperture. In some examples, the ice dispensing interface 60 can be biased in a closed position and coupled with an electrically actuable device, such as a servo motor, that moves the flap 62 between the closed position and an open position. In some instances, a user may be capable of choosing various amounts of ice to be dispensed from the hopper 54. In such instances, the flap 62 may be moved for the closed position to the open position for predefined periods of time correlating the amount of ice chosen by the user. Additionally or alternatively, the agitator 56 may be operated for various predefined times to move a desired amount of ice through the aperture. It will be appreciated that the amount of ice moved through the aperture can be detected or monitored through any type of sensor positioned within the hopper 54, along the chute, in the chamber 24, or at any other location.

A protective structure 40 may be operably coupled with the cabinet 12 and surround the cooling module 50. For example, as illustrated in FIG. 1A, the protective structure 40 may define a cavity 42 and include a grill 44. When the cooling module 50 is in use, heat is rejected therefrom that is transferred to the ambient environment proximate to the cooling module 50, which allows for a more efficient ice machine 10. In some instances, the cabinet 12, the one or more doors 20, 26, and the protective structure 40 may each be formed a metallic, polymeric, and/or any other practicable material.

In some examples, such as the ones illustrated in FIGS. 1A, 2A, and 2B, a gasket 69 may be disposed around the perimeter of the front access opening 16, and/or the top access opening 18 or portions of either opening. The gasket 69 may be disposed between the cabinet 12 and the cabinet door 20 when the cabinet door 20 is placed in a closed position. Likewise, the gasket 69 may additionally or alternatively be positioned between the protective cover and the cabinet 12 when the protective cover is placed in an assembled position. The gasket 69, when positioned in any location, may be configured to further prevent heat transfer between the compartment 14 of the cabinet 12 and the ambient environment surrounding the cabinet 12, a softer closing, assist with masking offsets/tolerances, prevent noise, vibration, or harshness when the cooling module 50 is in use, and/or assist with any other function.

With reference to FIGS. 2A-7, the frame 46 includes a base portion 64 and a support portion 66. The base portion 64 includes a pedestal 68 that anchors one or more legs extending upwardly therefrom. In some examples, the cabinet 12 and the pedestal 68 can be integrally formed or a common component. A bottom portion of the one or more legs is operably coupled with the pedestal 68 to provide additional rigidity to the legs. In various embodiments, the bottom portion of the one or more legs may have a width that is greater than a width of an intermediate portion of the one or more legs. The wider bottom portions may allow for additional fastening of the legs to the pedestal 68 and/or provide a sturdier base than a narrower leg.

Additional supports 70 may couple to the legs on opposing end portions of the supports. For example, a first support 70*a* may extend from a rearward leg to a forward leg, as illustrated in FIGS. 2A and 2B. A second support 70*b* may extend between a pair of forwardly positioned legs. The additional supports may be integrally formed with one or more of the legs or later attached thereto.

In the examples illustrated in FIGS. 2A and 2B, a trough 72 is coupled with one of the supports 70*b*. The through may be formed with or fixed to the second support and include a base section and a plurality of walls extending upwardly therefrom. The base section may be non-parallel to the pedestal 68 of the frame 46 to assist in directing fluids therein towards a fluid outlet 74 that is coupled with the trough 72. The fluid outlet 74 may be configured to remove fluids from the cabinet 12.

The support portion 66 is supported by the base portion 64 of the frame 46 on a lower portion and supports the cooling module 50 on an opposing upper portion. The support portion 66 can include one or more brackets that couple with the cooling module 50 and/or the base portion 64 of the frame 46. In addition, the support portion 66 may house the motor 58 and/or any other practicable components.

In some examples, such as the embodiments illustrated in FIGS. 2A and 2B, various components can be disposed within the cabinet 12 in an offset relationship from the frame 46 (i.e., the various components may be positioned within the compartment 14 but laterally or longitudinally offset from the frame 46). For example, a control panel 76 can be positioned on an opposite side of the compartment 14 from the frame 46. The control panel 76 may include various switches and controls for controlling the various components of the ice machine 10. In the embodiments illustrated in FIGS. 2A and 2B, the control panel 76 can be housed in an enclosed housing 78, which may protect the control panel 76 from containments and/or water vapor within the compartment 14.

A water valve assembly 80 may be positioned in a laterally offset orientation from the frame 46 within the cabinet 12 and fluidly coupled with a water supply that is external to the compartment 14. The water valve assembly 80 can include a control valve and/or a flow meter for measuring a water pressure within the valve assembly.

In some examples, a sump 128 is defined by the cabinet 12. The cooling module drain pipe 51 fluidly coupled with the cooling module 50 and/or a drain hose 55 fluidly coupled with the hopper 54 may direct unwanted fluid to the sump 128. A sump pump 130 is configured to remove the unwanted fluid from the sump 128. In various examples, the sump pump 130 may include an inlet hose 132 that is positioned at or near the bottom of the sump 128. The sump pump 130 may include a float switch assembly 134, which forms part of an electric circuit including a power cord which supplies electric power to the pump motor upon the water level in the sump 128 rising to a first predetermined level. This causes the pump 130 to discharge water from the sump 128 through a discharge pipe 136 to a storm drain or other water dispersal facility. The float switch assembly 134 interrupts the application of electric power to the pump motor when the water level in the sump falls to a second predetermined level below the first predetermined level.

In some examples, such as the embodiment illustrated in FIG. 2B, the valve assembly 80 may be coupled with a conduit that supplies water to a water filtration assembly 82.

The water filtration assembly 82 may include a particulate filter for removing dirt, sand, rust and other large and fine particles from the water and in some cases a carbon filter for removing chlorine. The water filtration assembly 82 may additionally or alternatively include a filter that utilizes granular activated charcoal, silver-impregnated ceramic, deionization, distillation or reverse osmosis, or a combination thereof and include any number of filtration canisters through which the water may pass.

The cabinet door 20 may also support various components of the ice machine 10 which may have a first portion that is accessible on an exterior side of the cabinet door 20 and a second portion that is accessible from the interior side of the cabinet door 20. For instance, in the examples illustrated in FIGS. 8 and 9, the various components may include illuminable signage 84, a payment station 86, and/or a switch assembly 88. The illuminable signage 84 may display any desired information to an on-looker of the ice machine 10 through the use of a light assembly. The light assembly may be illuminated any time the ice machine 10 is in service, during predefined time periods, or during low-light conditions, such as at night. In examples in which the light assembly is illuminated during low-light conditions, the light assembly may be operably coupled with a light sensor.

The payment station 86 is configured to accept bills, coins, credit cards, and other forms of payment. In some examples, the payment station 86 may include a payment interface in which prices for various quantities of ice may be set. Additionally, the payment interface may be coupled with a remote electronic device and the prices and/or any other information may be provided or updated from the remote electronic device.

Figure 8:
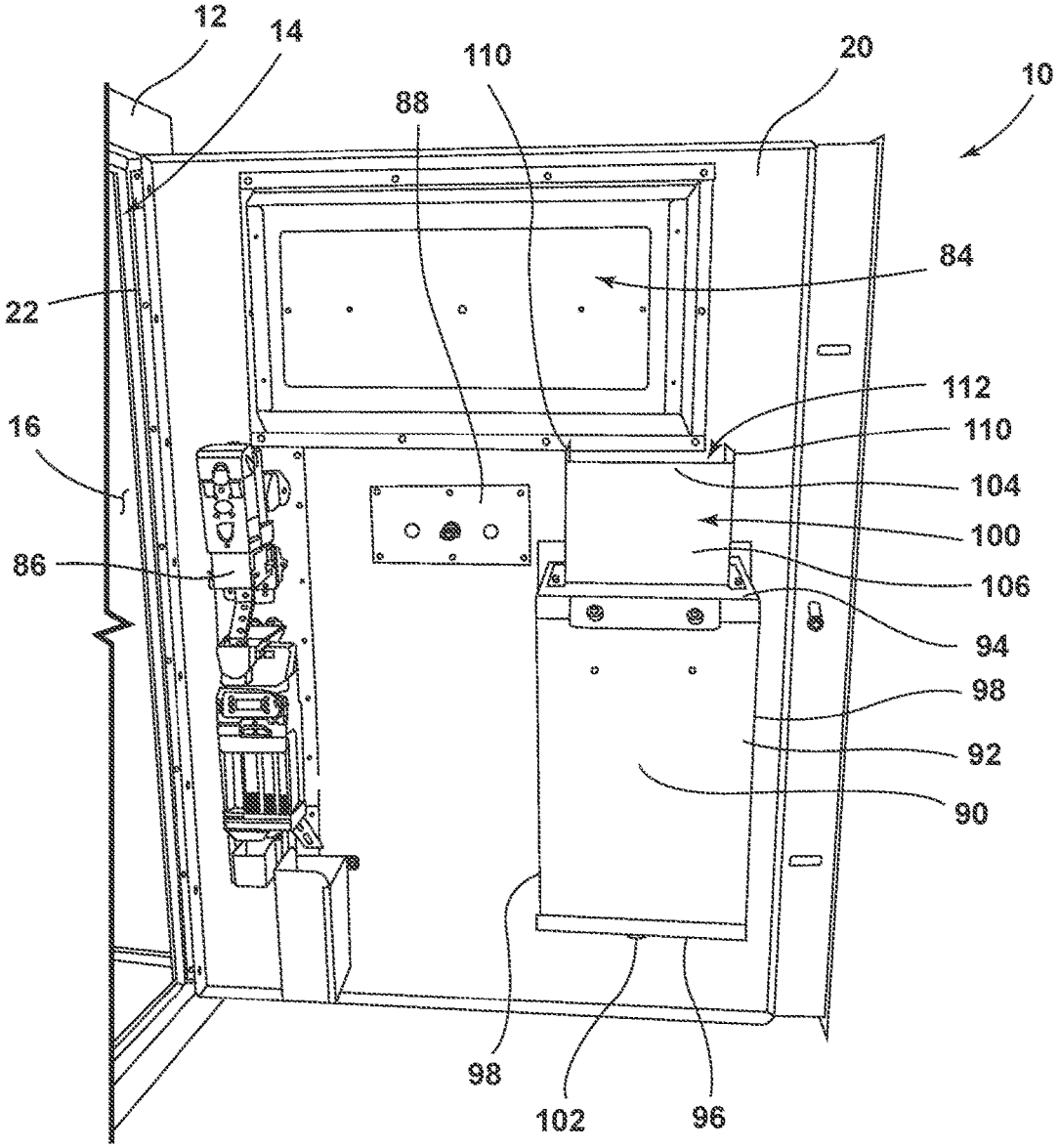
FIG. 8 is a rear perspective view of the cabinet door, according to some examples.
Figure 9:
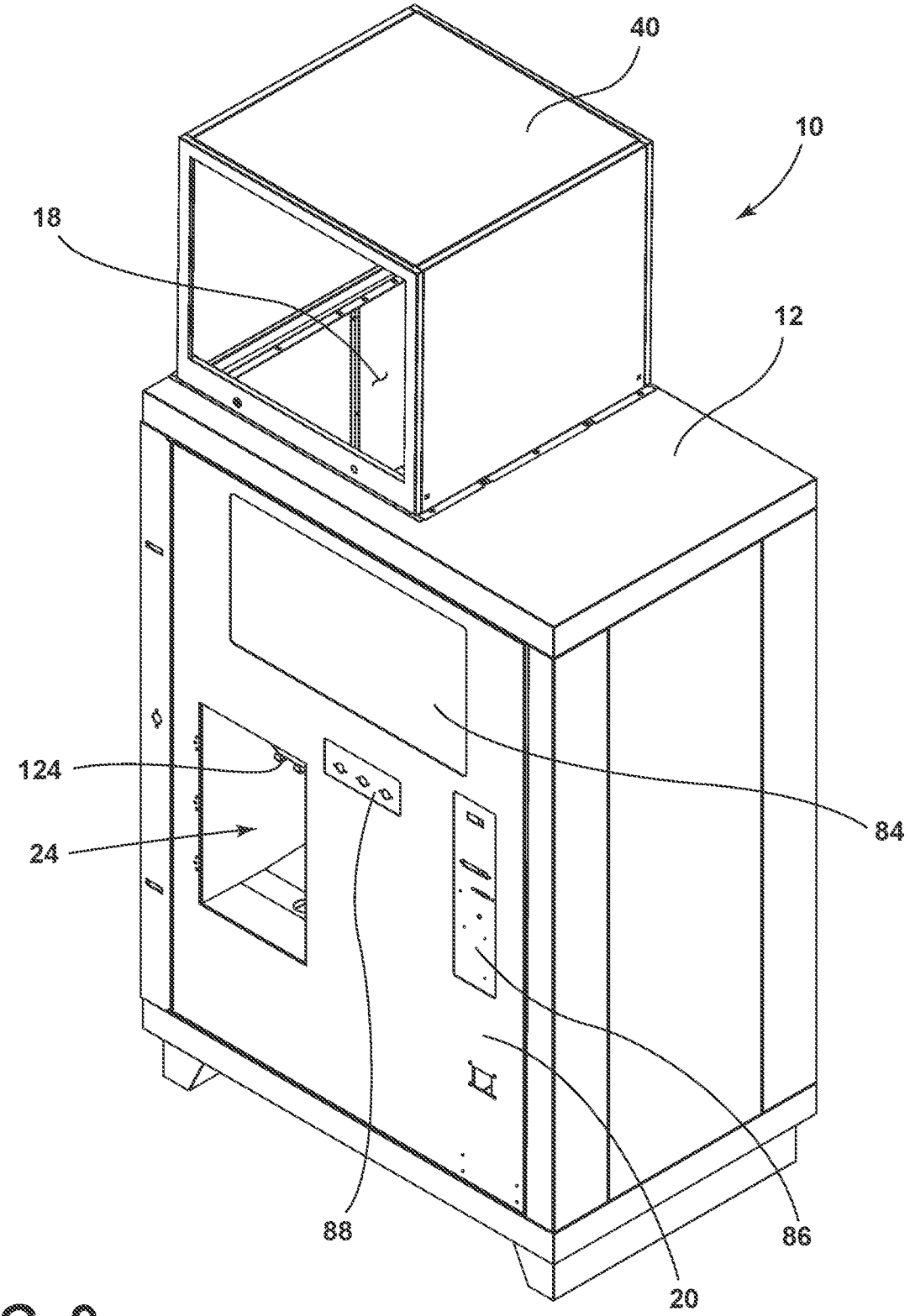
FIG. 9 is a front perspective view of the ice machine, according to some examples.

Upon receipt of payment, ice can be dispensed into a container, bag, cup, bin, ice chest, etc. and delivered to the consumer through actuation of the switch assembly 88. As illustrated in FIGS. 8 and 9, the switch assembly 88 is in the form of an electronic push-button, though it should be understood that any suitable input device, such as a toggle switch, rocker switch, or microswitch could also be utilized. In some examples, the switch assembly 88 may additionally, and/or alternatively, be configured as a capacitive sensor. The capacitive sensor provides a sense activation field that encompasses an area proximate the switch assembly 88 and can detect capacitive changes resulting from a conductor, such as a finger of a user, being within the sense activation field of the capacitive sensor. It will be appreciated, however, that additional or alternative types of proximity sensors can be used for detecting various other signal changes, such as, but not limited to, inductive sensors, optical sensors, temperature sensors, resistive sensors, the like, or combinations thereof.

A housing 90 is operably coupled with the cabinet door 20 and, in combination with the cabinet door 20, defines an ice harvesting chamber 24. For example, as illustrated in FIGS. 8-11, the housing 90 includes a rear wall 92, an upper wall 94, a lower wall 96, and a pair of side walls 98. The upper wall 94 may define an opening through which a chute 100 extends. The lower wall or bottom 96, which is conventionally formed at a single horizontal level, may be structured to define a drain 102 that may be aligned with the trough 72 such that any fluid (~water condensate, for example) exiting the drain 102 can be caught by the trough 72 when the cabinet door 20 is placed in the closed position.

Figure 10:
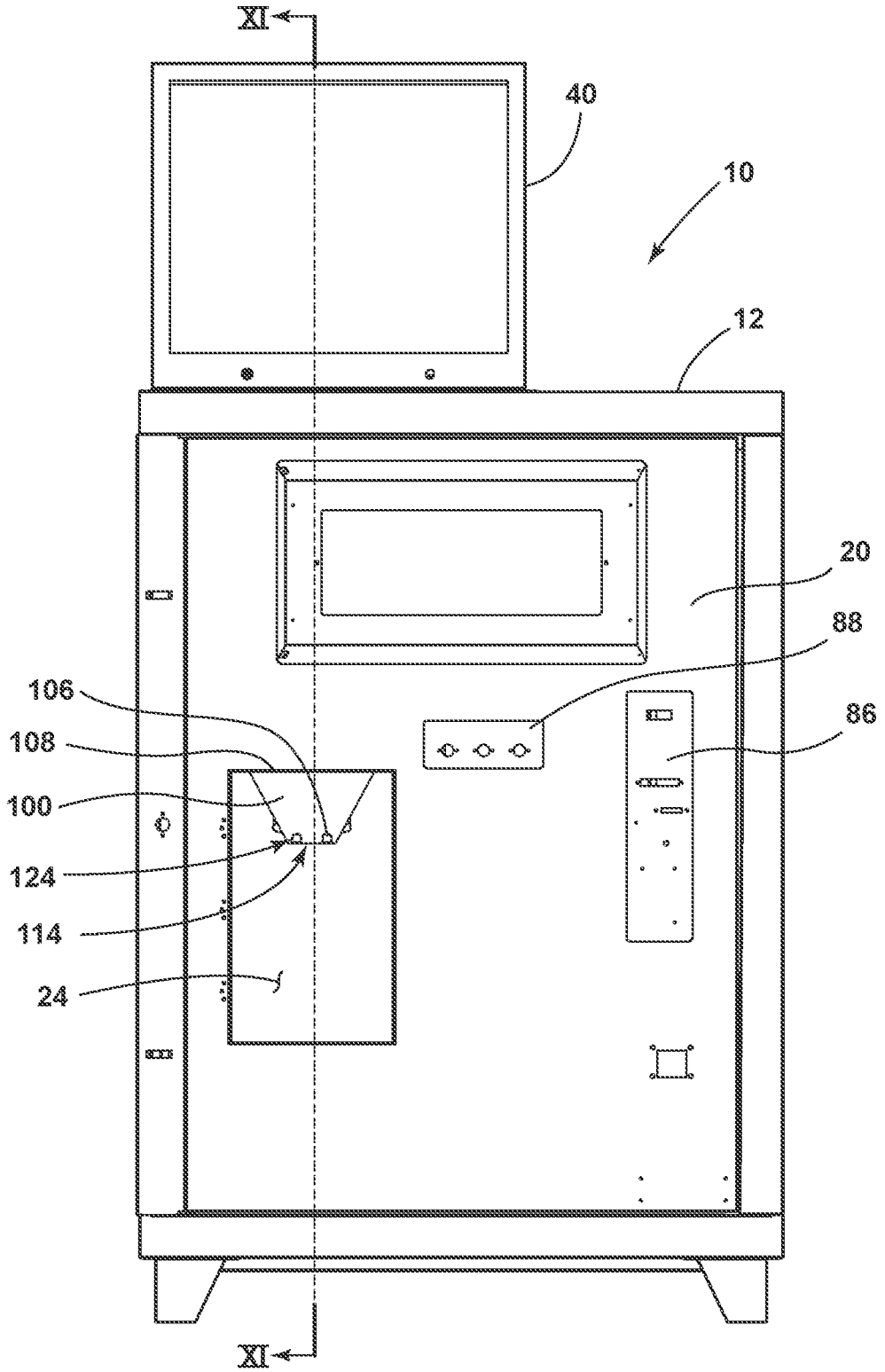
FIG. 10 is a front plan view of the ice machine, according to some examples.

The chute 100 can be in communication with the ice dispensing interface 60 of the cooling module 50 and extend through the housing 90 to terminate within the ice harvesting chamber 24. The chute 100 has a body 104 that can be defined by a rear wall 106, a front wall 108, and a pair of side walls 110 coupling with the rear and front walls 106, 108. The chute 100 has an upper portion 112 that extends above the housing 90, as illustrated in FIG. 8, and a lower portion 114 that terminates within the ice harvesting chamber 24, as illustrated in FIG. 10. In some examples, such as the one illustrated in FIG. 8, the side walls may extend vertically above the front and/or the rear wall 106 proximate the upper portion 112. In such instances, the side walls may be positioned on opposing sides of the flap 62 and assist in guiding ice from the hopper 54 through the chute 100 when the flap 62 is moved to the open position.

Figure 11:
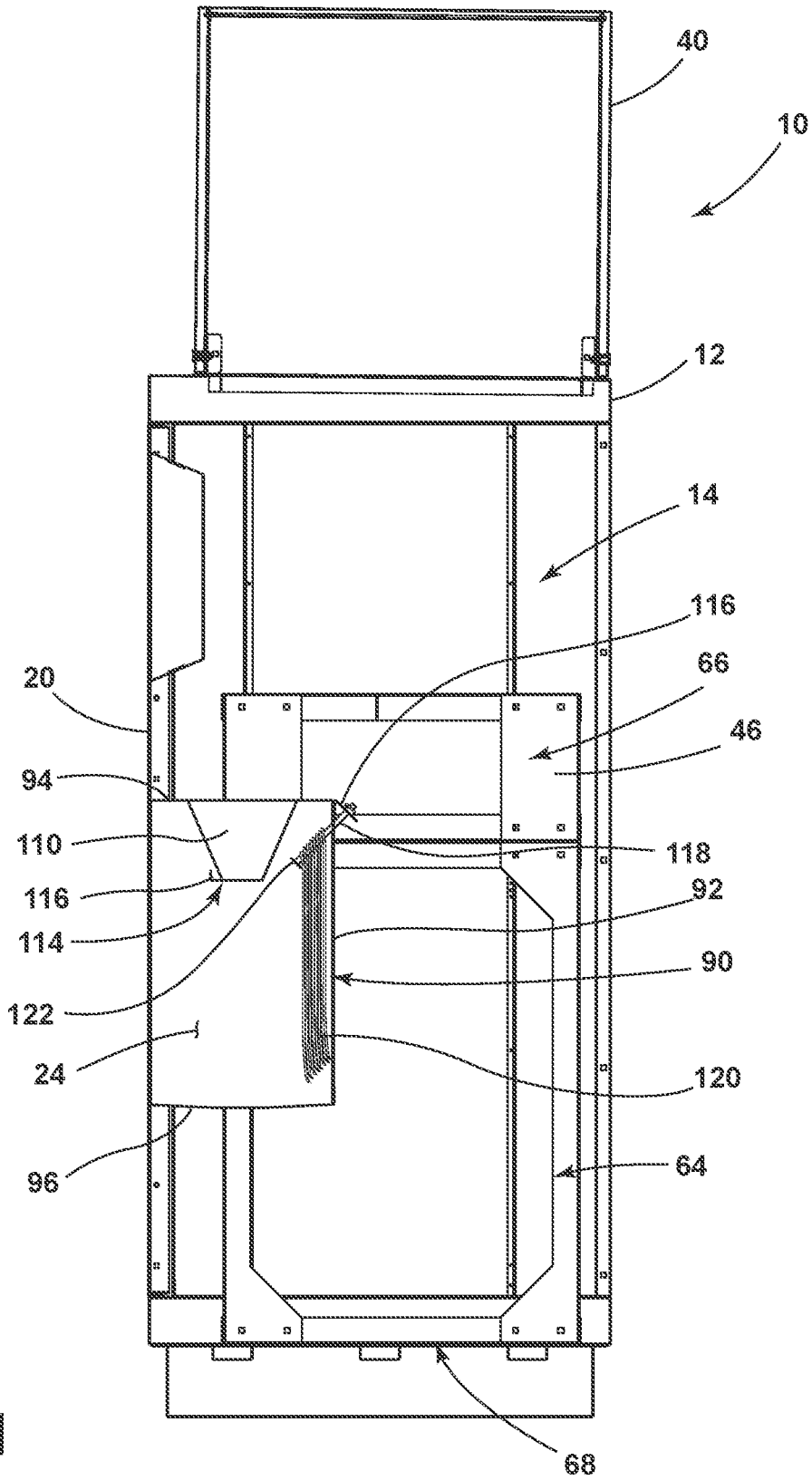
FIG. 11 is a cross-sectional view of the cabinet and the frame taken along the line XI-XI of FIG. 10.
Figure 12D:
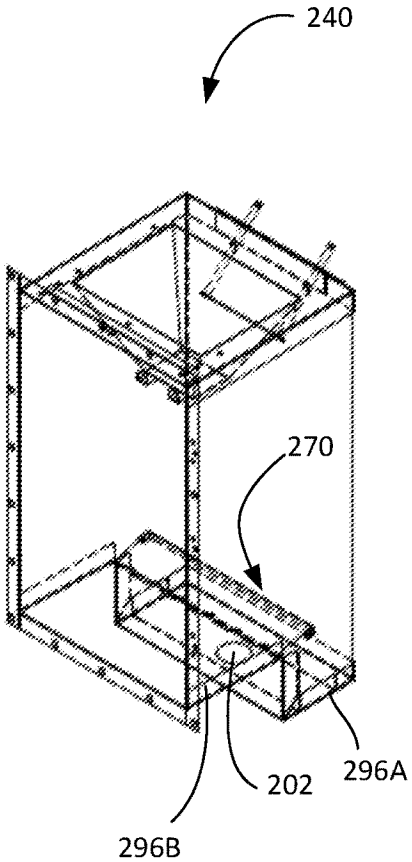
FIGS. 12A, 12B, 12C, 12D schematically illustrate a specific implementation of the ice harvesting chamber (interchangeably referred to herein as a vending compartment) of the ice machine.
Figure 12B:
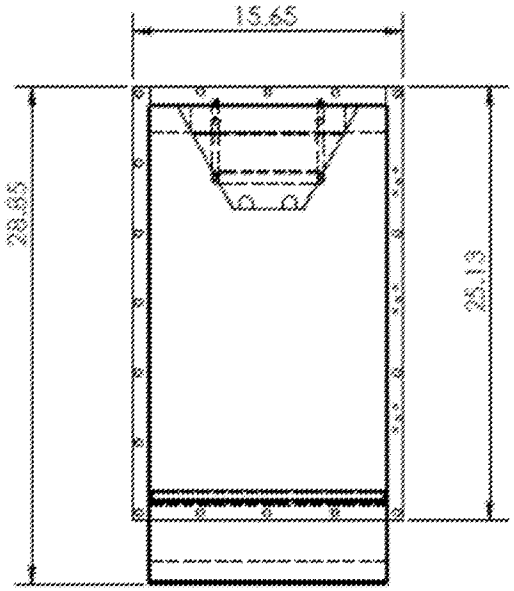
Figure 12C:
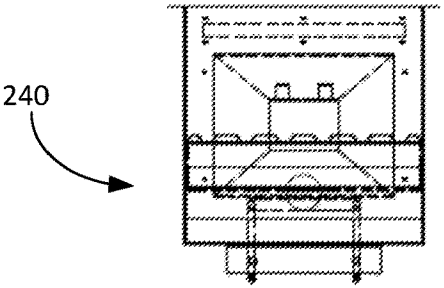
Figure 12A:
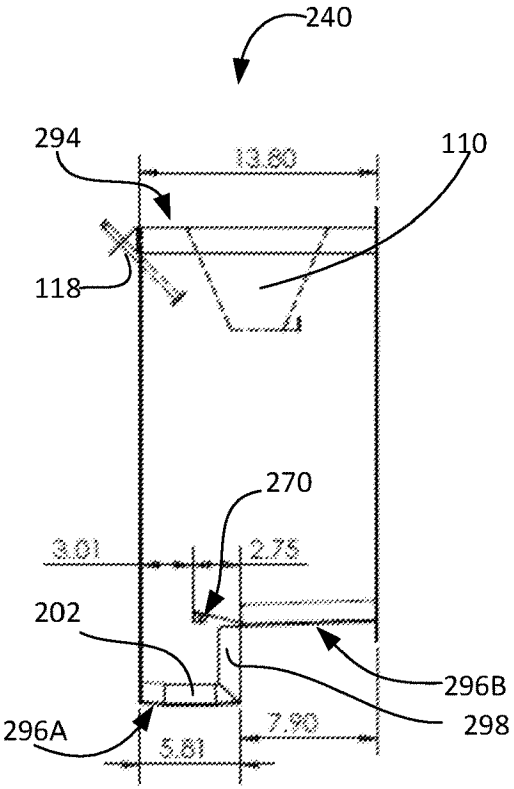

In some examples, such as the embodiment illustrated in FIGS. 10 and 11, a brace 116 may extend away from a rear wall 92 of the housing 90, or any other wall of the housing 90, on an opposing side of the housing 90 from the chute 100. The brace 116 may be integrally formed with any portion of the housing 90 or later attached thereto.

An attachment rod 118 is coupled with the brace 116 on a first end portion and extends through the rear wall 92 of the housing 90. However, in some examples, the attachment rod 118 may be coupled with a brace 116 or the housing 90 within the ice harvesting chamber 24 rather than extending through the housing 90. The attachment rod 118 may be elongated and capable of holding one or more containers 120 thereon and may be formed from a polymeric material, an elastomeric material, a metallic material, combinations thereof, or any other practicable material. In some examples, the ice machine 10 may include more than one attachment rod 118 for supporting a common container 120 or various containers 120.

A retainer 122 is positioned on a second end portion. The retainer 122 may have a width that is greater than the width of the attachment rod 118. Accordingly, when one or more containers 120 are placed on the attachment rod 118, the increased width of the retainer 122 may removable maintain the containers 120 on the attachment. In some examples, the retainer 122 may be positioned vertically above the lower portion 114 of the chute 100 and/or between the chute 100 and the rear wall 92 of the housing 90.

In various examples, one or more containers 120 may be maintained on the attachment rod 118 and generally prevented from falling off of the attachment rod 118 by the retainer 122. In some instances, the containers 120 may be preassembled on the attachment rod 118 such that a new attachment rod 118 with one or more containers 120 thereon is attached to the brace 116 when additional containers 120 are needed. In other instances, additional containers 120 may be attached to the attachment rod 118 such that the rod may be used multiple times.

In various examples, the chute 100 can include a container hanging assembly 124 thereon, which may be integrally formed with the chute 100 or later attached thereto. For example, as illustrated in FIGS. 10 and 11, the container hanging assembly 124 extends from the second end portion of the chute 100 in the form of a pair of hooks 126. The hooks 126 can include a first segment that extends away from the second portion of the chute 100 and a second segment that extends upwardly from the first segment.

In use, a stack or group of containers 120 hangs from the attachment rod 118. When a user is to collect ice that is dispensed from the chute 100, the user attaches a portion of the target container 120 (that is typically the first one in the stack facing the user) to the container hanging assembly 124 while the container 120 is still retained on the attachment rod 118 to generally vertically align an opening of the container 120 with the opening of the chute 100. Next, the user utilizes the actuation switch to dispense ice into the target container 120. Once the ice is within the target container 120, the target container 120 is removed from the attachment rod 118 (with the rest of the stack of the containers still hanging from the attachment rod) and the container hanging assembly 124 and removed from the ice harvesting chamber 24.

A person of skill appreciates that, in practice, when the bottom 96 of the vending compartment 24 (housing 90) is at a single level, the fluid formed by condensations and/or melting of ice often comes in contact with the pack of containers or bags 120, making them stick to one another as a result of the capillary effect and thereby complicating the use of these containers (by making it difficult for the use to separate one container from another) FIGS. 12A, 12B, 12C, and 12D illustrate a specific implementation 240 of the ice harvesting chamber (aka vending compartment) 24 in side, front, top, and perspective views, respectively. The embodiment 240 judiciously structured to ensure that containers 120 (when place in the vending compartment) do not come in physical contact with the water condensation and/or water accumulation at the bottom or the walls of the ice harvesting chamber while, at the same time, continuing to provide support from below to the target container that is being filled with ice. In stark contradistinction with the conventionally-employed structure of the vending compartment, the floor or bottom of the compartment 240 is dimensioned at multiple levels (as shown—containing two bottom portions 296A, 296B) with respect to the top (or upper wall) 294 of the compartment 240. The bottom portion 296A at the lower level may be configured to include a drain 202. To provide for the continuity of the bottom of the vending compartment 240, the bottom portions 296A, 296B may be optionally connected with a wall 298, thereby aggregately forming a step-like structure. The vending changer 240 may be dimensioned such that the upper bottom portion 296B bears or holds from below the stack of containers 120 disposed (as shown, for example, in FIG. 11) inside the chamber 240. Optionally, an additional plank-like support 270 can be (preferably removably) affixed to the upper bottom portion 296B to extend and terminate over the edge of the portion 296B, which in operation facilitates the support of the filled-with ice container 120 during the removal of the container 120 from the chamber 240. In one implementation, the plank-like support 270 can be affixed to the portion 296B at an angle and/or the free edge of the support 270 can be spatially-curved to prevent the tear of a container 120 rubbing against such edge. Dimensions of the components of the chamber 240 (indicated in FIGS. 12A-12D) are those of a specific embodiment, and are not intended to be limiting.

It is appreciated that in a related embodiment, the bottom portion of the chamber 240 can be formed as a substantially planar or substantially curved surface that does not have a step-like profile but that is affixed to the side walls of the chamber (compare with the side walls 98 of FIG. 11) at an angle such as to define different vertical depths of the chamber 240 (and, therefore, different levels of separations from the top 294) at different locations along the bottom portion.

The ice machine of the present disclosure may offer a variety of advantages. For instance, use of the ice machine may allow for easy access to containers within the ice harvesting chamber. By hanging the containers, the containers may be generally removed from the bottom wall of the housing preventing the containers from contributing to excess fluid buildup in the ice harvesting chamber by maintaining an open drain. The reduced fluid buildup may allow for a higher perceived value and/or reduce the potential for mold buildup.

The ice machine provided herein may also allow for better operation through the combination of the housing forming the ice harvesting chamber and the chute that directs ice from the hopper into the ice harvesting chamber. Such configurations may increase the percentage of ice that is retained within the container upon dispensing from the hopper.

In addition, the offset frame assembly provided in some examples of the ice machine allows for various components to be used and/or supported by the frame while maintaining space within the compartment for various other components. The offset frame may also reduce the amount of material needed to support the components of the ice machine thereby reducing the cost of the ice machine.

It will be understood by one having ordinary skill in the art that construction of the described invention and other components is not limited to any specific material. Other non-limiting examples of the invention disclosed herein may be formed from a wide variety of materials unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable and/or physically interacting components and/or wirelessly interactable and/or wirelessly interacting components and/or logically interacting and/or logically interactable components.

It is also important to note that the construction and arrangement of the elements of the invention as shown in the provided examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other examples without departing from the spirit of the present innovations.

It will be understood that any described processes or steps within described processes may be combined with other disclosed processes or steps to form structures within the scope of the present invention. The examples of structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An ice machine comprising:

a cabinet defining a compartment and having a cabinet door coupled thereto through a hinge assembly;

a frame removably positioned within the cabinet and laterally offset relative to a lateral centerline of the compartment, a hopper that is supported by the frame, the hopper including an ice dispensing interface;

a housing having a top and a bottom and affixed to the cabinet door to be moved from inside the compartment when the cabinet door is opened, said housing defining an ice harvesting chamber, wherein the bottom of the housing includes a surface that is separated from the top by a first distance at a first location at said surface and by a second distance at a second location at said surface, the first distance being different from the second distance;

a chute coupled with the housing and in communication with the ice dispensing interface;

a container hanging assembly operably coupled with the chute;

an attachment rod; and a drain defined in the bottom of the housing.

2. The ice machine of claim 1, wherein the container hanging assembly includes one or more hooks supported by the chute.

3. The ice machine of claim 1, wherein a chamber door is hingedly coupled to the cabinet door to rotate the cabinet door relative to the cabinet from a first closed position to a first open position in a first direction, and from a second closed position to a second open position in a second direction that is opposite the first direction.

4. The ice machine of claim 1, wherein an upper wall of the housing defines an opening and the chute extends through the opening.

5. The ice machine according to claim 1, wherein the bottom of the housing includes a first bottom portion and a second bottom portion that are connected with one another by a connecting portion to form a step.

6. The ice machine of claim 1, wherein the cabinet door is rotatably coupled to the cabinet through the hinge assembly, the hinge assembly positioned on an opposing side of the cabinet from the frame.

7. The ice machine of claim 1, further comprising:

a motor at least partially housed within the support portion of the frame and configured to actuate the ice dispensing interface.

8. An ice machine comprising:

a cabinet defining a compartment with a compartment volume and having a cabinet door coupled thereto through a hinge assembly;

a frame surrounding a frame volume and removably positioned within the cabinet and including a base portion of the frame and a support portion of the frame, the frame laterally offset relative to a lateral centerline of the compartment, the frame volume being smaller than the compartment volume;

a hopper disposed on top of the support portion of the frame and having an ice dispensing interface; and a chute coupled with a housing that hangs on the cabinet door and in communication with the ice dispensing interface, wherein the housing has a bottom that is unequally distanced from the hopper at first and second locations along the bottom.

9. The ice machine of claim 8, further comprising:

a drain defined in the bottom of the housing; and a trough coupled with the base portion of the frame and fluidly coupled with a fluid outlet.

10. The ice machine of claim 8, further comprising:

a container hanging assembly including one or more hooks supported by the chute; and an attachment rod extending from the housing.

11. The ice machine of claim 8, further comprising:

a chamber door hingedly coupled to the cabinet door and configured to provide access to an ice harvesting chamber enclosed by the housing.

12. The ice machine of claim 10, further comprising:

a brace extending away from a rear wall of the housing on an opposing side of the housing from the chute.

13. The ice machine of claim 12, wherein the attachment rod extends through the rear wall of the housing, the attachment rod having a first end portion and a second end portion, the attachment rod attached to the brace at the first end portion and to a retainer at a second end portion.

14. An ice machine comprising:

a cabinet enclosing a compartment with a compartment volume and having a cabinet door hingedly coupled thereto;

a frame surrounding a frame volume that is smaller than the compartment volume, the frame being repositionably located within the cabinet and supporting a hopper, wherein the hopper is supported by the support portion of the frame and includes an ice dispensing interface, wherein the frame is offset from a lateral centerline of the compartment;

a housing defining an ice harvesting chamber with a bottom configured to define at least first and second levels of the bottom along a vertical direction, the housing attached to the cabinet door whereby the ice harvesting chamber is hinged away from the compartment volume when the cabinet door is opened;

a chute coupled with the housing and in communication with the ice dispensing interface; and an attachment rod attached to and extending through a rear wall of the housing and including a retainer on an end portion thereof, the retainer disposed vertically above a lower portion of the chute.

15. The ice machine of claim 14, further comprising:

a drain defined at the bottom of the housing; and a trough coupled to the frame, wherein the trough is positioned below the drain when the cabinet door is in a closed position.

16. The ice machine of claim 14, comprising a brace that extends away from a rear wall of the housing on an opposing side of the housing from the chute and that supports a first end portion of the attachment rod.

17. The ice machine of claim 14, further comprising:

a filter assembly positioned on an opposing side of the lateral compartment centerline from the frame, the frame volume being smaller than a compartment volume.

18. The ice machine according to claim 14, further comprising a drain formed in the second level of the bottom, the second level of the bottom being father away from the chute than the first level of the bottom.

19. The ice machine of claim 14, further comprising:

a container hanging assembly including one or more hooks supported by the chute.

20. A vending compartment configured as an ice harvesting chamber for an ice machine, the ice machine including a cabinet defining a compartment and having a cabinet door coupled thereto through a hinge assembly;

a frame removably positioned within the cabinet and laterally offset relative to a lateral compartment centerline, a hopper that is supported by the frame, the hopper including an ice dispensing interface; and a chute in communication with the ice dispensing interface;

wherein the vending compartment has a top and a bottom and affixed to the cabinet door to be moved from inside the compartment when the cabinet door is opened, wherein the bottom includes a surface that is separated from the top by a first distance at a first location at said surface and by a second distance at a second location at said surface, and wherein the first distance being different from the second distance.

* * * * *